US005975399A

United States Patent [19]

Oehri et al.

[11] Patent Number: 5,975,399

[45] Date of Patent: Nov. 2, 1999

[54] DRIVING APPARATUS WITH MAGAZINE FOR FASTENING ELEMENTS

[75] Inventors: Kurt Oehri, Schaan; Matthäus Hoop, Eschen, both of Liechtenstein; Harald Geiger, Germering, Germany

[73] Assignee: Hilti AKtiengesellschaft, Schaan, Liechtenstein

[21] Appl. No.: 09/028,532

[22] Filed: Feb. 24, 1998

[30] Foreign Application Priority Data

Feb. 24, 1997 [DE] Germany ..... 197 07 235

[51] Int. Cl.[6] ..... B25C 3/00

[52] U.S. Cl. ..... 227/120; 227/126; 227/136

[58] Field of Search ..... 227/126, 136, 227/125, 135, 119, 114, 120, 116

[56] References Cited

U.S. PATENT DOCUMENTS

| | | | |
|---|---|---|---|
| 602,971 | 4/1898 | Young | 227/136 |
| 3,174,672 | 3/1965 | Juilfs | 227/120 |
| 3,266,697 | 8/1966 | Fiedler | 227/120 |
| 3,437,249 | 4/1969 | Baum | 227/120 |
| 3,612,383 | 10/1971 | Perkins | 227/125 |
| 4,197,974 | 4/1980 | Morton | 227/120 |
| 4,389,012 | 6/1983 | Grikis | 227/120 |
| 4,624,401 | 11/1986 | Gassner | 227/126 |
| 5,653,371 | 8/1997 | Hou | 227/120 |

*Primary Examiner*—Peter Vo
*Assistant Examiner*—James P Calve
*Attorney, Agent, or Firm*—Brown & Wood, LLP

[57] ABSTRACT

Apparatus for driving fastening elements (9), such as nails, bolts, screws, clips and alike, includes a magazine (3) extending laterally from a guide (1) from which the fastening elements are driven. A transport slide (4) is mounted on the magazine (3). A guide channel (31) in the magazine (3) opens into the guide (1) and is open at its opposite end located at a free end of the magazine. The transport slide (4) is movable along the magazine (3) towards its free end into a release position and in the release position can be fixed against movement toward the guide (1). In the release position, the transport slide (4) has a transport latch (41), and a retaining element (6) is positioned on the magazine (3), and both are displaced out of the clear opening in the guide channel (31).

8 Claims, 4 Drawing Sheets

DRIVING APPARATUS WITH MAGAZINE FOR FASTENING ELEMENTS

BACKGROUND OF THE INVENTION

The present invention is directed to an apparatus for driving fastening elements, such as nails, bolts, screws, clips and the like, into a receiving material and includes a guide extending parallel to the driving direction with a magazine mounted on and extending outwardly from the guide. The magazine forms a guide channel substantially perpendicular to the guide and arranged to receive a carrying strip holding the fastening elements to be transported into the guide. A transport slide is mounted on the magazine for movement thereon between a release position, a working position and an end position adjacent to the guide. The guide channel is open at the free end of the magazine and the transport slide is movable along the magazine towards the free end thereof against the force of a spring. The transport slide has a spring-like transport latch and a spring-like retaining element is mounted on the magazine with the transport latch and the retaining element being arranged to extend into a clear opening in the guide channel for contact with at least one of the carrying strip and the fastening elements.

In a known fastening element driving apparatus, disclosed in British patent 1,281,586, a magazine projecting perpendicularly from a guide has a spring-like retaining element extending into a clear opening of a guide channel. On the magazine, there is a transport slide with a spring-like transport latch which also projects into the clear opening of the guide channel and can be displaced towards the free end of the magazine against the force of the spring. The carrying strip with the fastening elements located in the guide channel cannot be removed opposite to the transport direction of the guide channel, since the transport latch along with the retaining element project into the clear opening of the guide channel and interact positively with the carrying strip. Such removal can take place only in the transport direction through a through hole in the guide located opposite the guide channel. When the carrying strip is pulled out of the guide channel, the holding forces produced by the retaining element and the transport latch acting on the carrying strip must be overcome at the same time.

SUMMARY OF THE INVENTION

Therefore, the primary object of the present invention is to provide a driving apparatus for fastening elements including a magazine and a transport slide, so that a carrying strip can be removed easily and quickly counter to the transport direction from the magazine without the expenditure of any force.

In accordance with the present invention, the driving apparatus has the transport slide displaceable along the magazine into a release position. In this release position, a transport latch on the slide and a retaining element associated with the magazine can be displaced out of the clear space or opening in the guide channel and with the transport slide fixed at the free end of the magazine.

Since the transport latch and retaining element in the release position of the transport slide are displaced out of the clear opening of the guide channel, a carrying strip of fastening elements, located in the guide channel, can be removed easily and quickly out of the magazine opposite to the transport direction without the expenditure of force. With the transport slide fixed at the free end of the magazine, the operator can hold the apparatus in one hand and remove the carrying strip from the magazine with the other hand, without holding the transport slide in the release position.

To secure the transport slide in the release position where it is held under tension by means of a spring, the transport slide is fixed by means of a stop surface on the transport slide facing towards the guide and can be positively connected with a stop shoulder on the magazine facing away from the guide. So that the stop surface of the transport slide can grip behind the stop shoulder, the part of the transport slide having the stop surface, is formed spring-like or elastic. Due to its spring-like character or elasticity, the stop surface of the transport slide can easily grip behind the shoulder and, in addition, the positive connection between the magazine and the transport slide can easily be canceled. For manufacturing reasons, preferably the release position of the transport slide is located in the free end region of the magazine, and the stop shoulder which interacts with the transport slide is formed by the free end of the magazine.

To fix the transport slide at the magazine in a simple and rapid manner, advantageously the transport slide has a main body with a two-arm lever pivotally mounted on the main body with the stop surface formed on a first lever arm and facing away from the guide and the transport latch being located at a second lever arm facing the guide. By simply pivoting the two-arm lever, the stop surface on the transport slide engages behind the stop shoulder of the magazine and the transport latch, located on the second lever arm, no longer projects into the clear opening in the guide channel.

Since the two-arm lever is freely rotatable about its axis of rotation, it must be insured that the transport latch, located at the second lever arm cannot swivel out of the clear opening of the guide channel when the transport slide is moved to ensure that the carrying strip is transported towards the guide. Accordingly, the two-arm lever of the transport slide is preferably supported in a working position and in an end position by the second lever arm at the outside of the magazine.

To ensure that the two-arm lever can be swiveled or pivoted easily and simply by the operator, preferably it can be rotated about an axis of rotation extending parallel to the driving direction of the fastening elements.

The retaining element is arc-shaped and projects through a lateral opening in the magazine into the clear opening of the guide channel. It can be displaced out of the clear opening of the guide channel, since it can be shifted along the magazine opposite to the transport direction, and at the same time, it is pulled about an edge formed by the opening, whereby the retaining element is moved out of the clear opening of the guide channel. To facilitate the shifting of the retaining element, advantageously it interacts with a carriage connected with the magazine and can be shifted partially towards the free end of the magazine by the transport slide against the force of a spring element.

For manufacturing reasons, preferably the carriage has a pulling face directed toward the guide and interacts positively with a pulling shoulder of the transport slide facing away from the guide. The pulling face is formed by the outer contour of a cylindrical pin.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
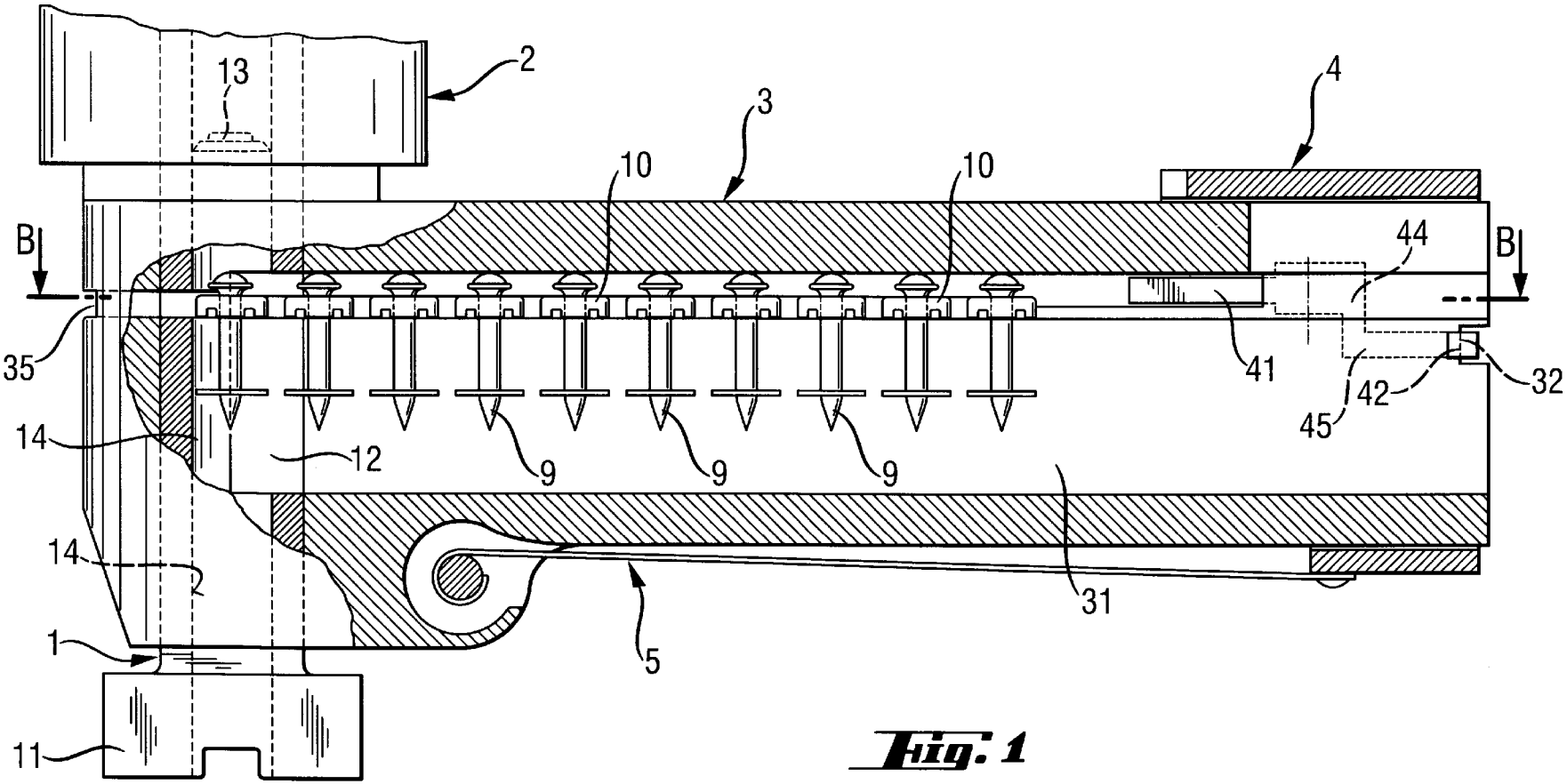
FIG. 1 is a side elevational view of a part of the inventive driving apparatus with the magazine shown mainly in section.

In FIGS. 1 to 4, an apparatus for driving fastening elements, such as nails, bolts, screws, clips and the like in a driving direction into a receiving material, not shown, includes an apparatus housing 2, shown only in part, with a guide 1 extending axially at least partially from the housing in the driving direction. At its lower end, as viewed in FIG. 1, the guide 1 has a bed plate 11. The guide 1 has a central through-bore 14, extending in the driving direction and serving for partially guiding the shaft of a driving piston 13 shown in phantom within the housing 2 and for holding a fastening element 9 before it is driven by the piston 13 into a receiving material, not shown.

A magazine 3 holding a number of fastening elements 9 projects laterally from the guide 1 and is located between the housing 2 and the bed plate 11. The magazine 3 laterally encloses the guide 1 and has a guide channel 31 extending substantially perpendicularly to the driving direction and opening into a radially extending opening 12 in the guide 1. In the guide channel 31, a carrying strip 10 holds a number of fastening elements 9 spaced apart from one another.

Figure 2:
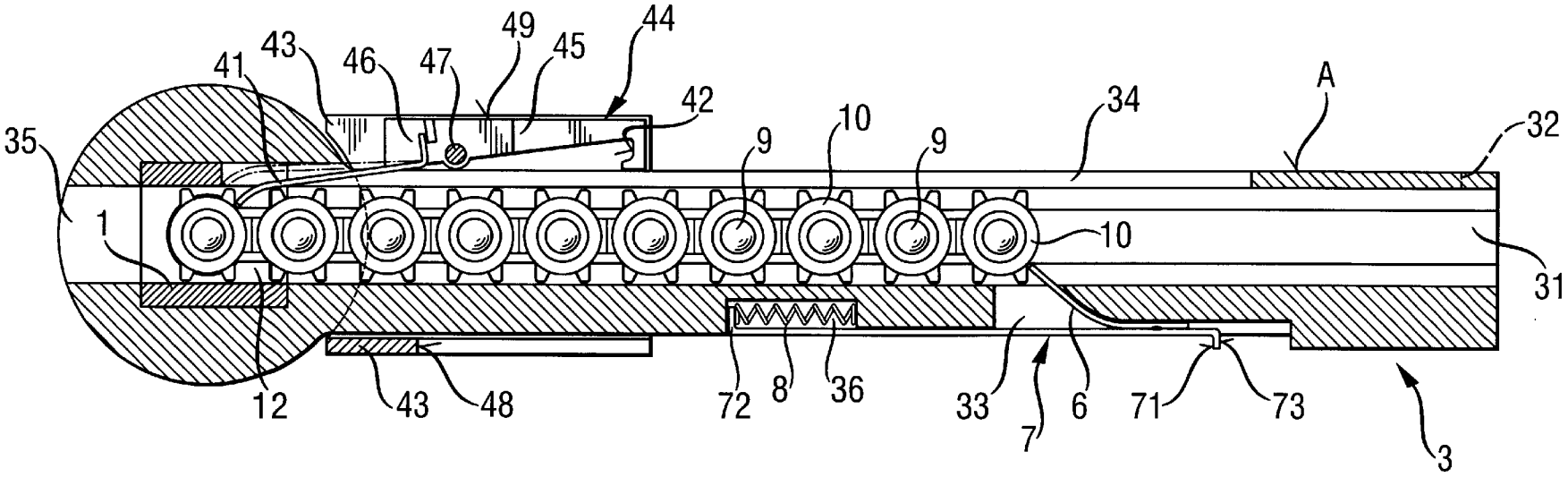
FIG. 2 is a sectional view taken along the line B—B of the driving apparatus shown in FIG. 1 with the transport slide illustrated in an end position.
Figure 3:
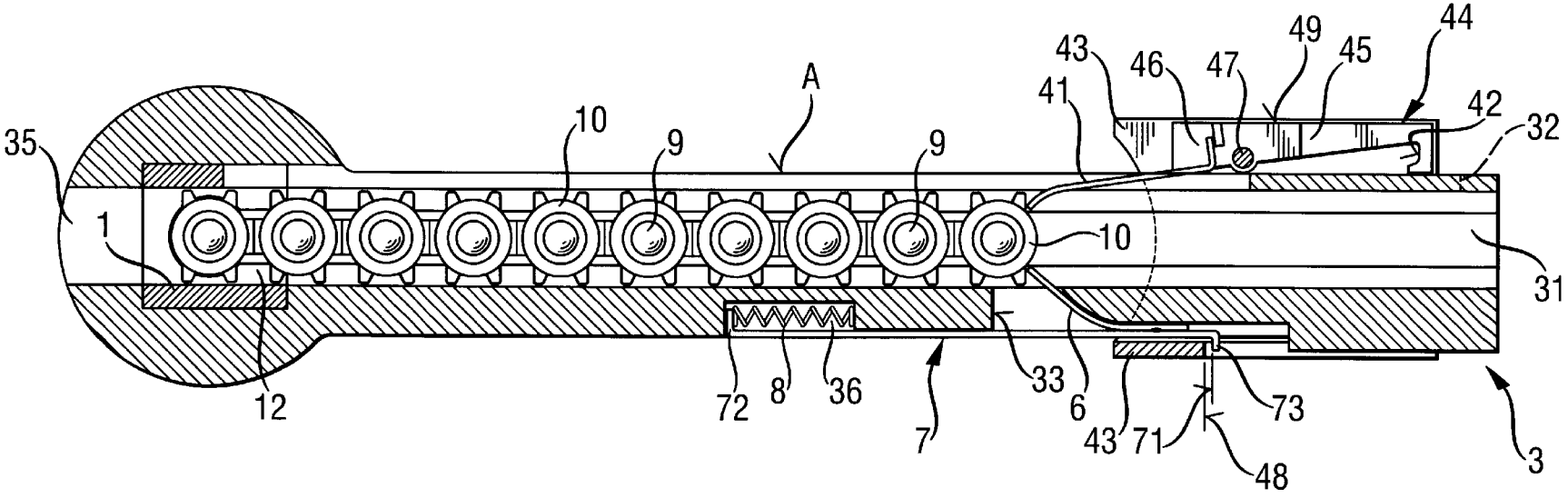
FIG. 3 is a sectional view similar to FIG. 2 taken along the line B—B of the driving apparatus in FIG. 1 with the transport slide located in a working position.
Figure 4:
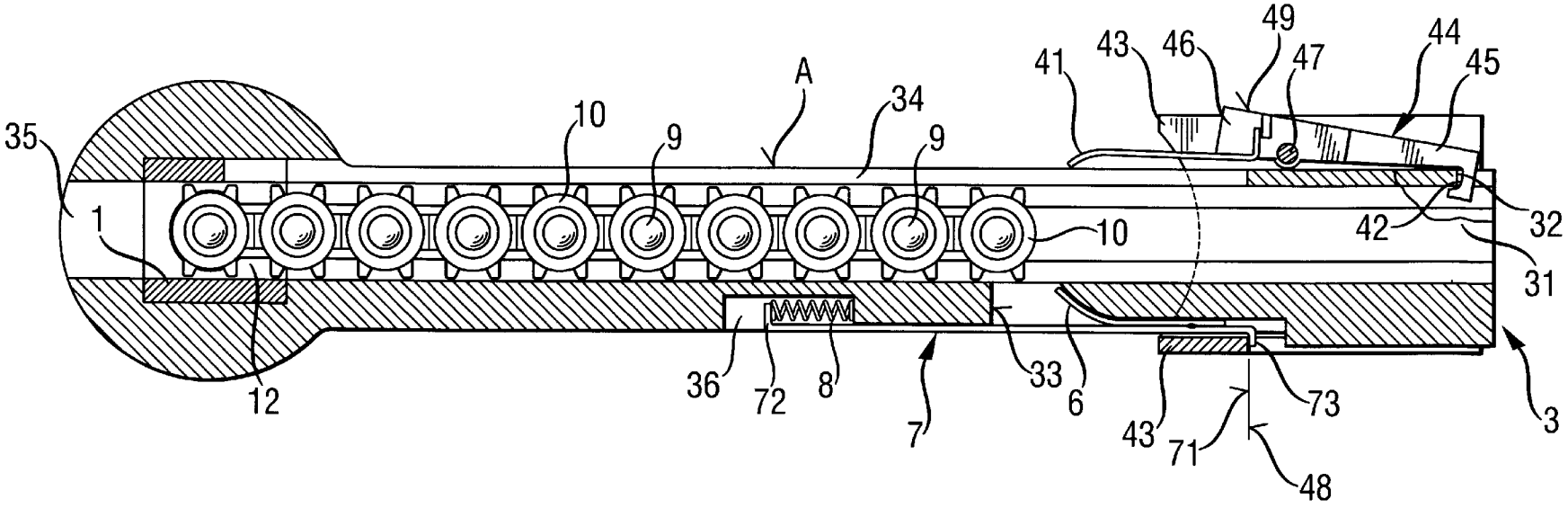
FIG. 4 is a view similar to FIGS. 2 and 3, taken along the line B—B of the driving apparatus shown in FIG. 1, with the transport slide fixed in a released position.

As shown in FIGS. 2–4, the magazine 3 has an outside surface A in which an elongated opening 34 extends parallel to and opens into the guide channel 31. Outside surface A extends from the guide 1 to an outer free end of the magazine 3.

The dimension of the opening 12, extending parallel to the driving direction, corresponds at least to the length of the fastening elements 9 to be driven. The width or dimension of the opening 12 extending transversely of the driving direction corresponds essentially to the largest diameter of the fastening elements.

On the opposite side of the guide 1 from the opening 12, the guide has a radially extending through hole 35 with a cross sectional area larger than the cross sectional area of the carrying strip 10. After each driving step, a portion of the carrying strip 10 can pass through the central through bore 14 of the guide and out to the hole 35. If this part of the carrying strip is required for guiding the fastening element within the central through bore 14, the guide 1 need not have the through hole 35.

At the radially outer free end of the magazine, the guide channel 31 is open. A transport slide 4, interacting with the magazine 3, can be displaced along outside surface A of the magazine against the force of a spring 5, in the form of a scroll spring, towards the free end region of the magazine. The scroll spring 5 is located in the region of the magazine 3 adjacent to the part surrounding the guide 1. The free end of the scroll spring 5 extends from adjacent to the guide 1 to the transport slide 4 to which it is firmly connected.

The transport slide 4 has a main body 43 supported on the outside surface A with an axis of rotation 47 extending parallel to the driving direction and with a two-arm lever 44 pivotally disposed on the axis of rotation 47. From the axis of rotation 47, a first lever arm 45 extends opposite to the transport direction and has at its free end a stop surface 42 facing toward the guide 1. From the axis of rotation 47, a second lever arm 46 extends in the transport direction and at its free end has an outwardly projecting transport latch 41 capable of extending the opening 34, note FIGS. 2 and 3. In the region of the axis of rotation 47, an actuating shoulder 49, facing outwardly from the guide channel 31, serves to pivot the two-arm lever 44, when the transport slide is in the release position of FIG 4.

The transport latch 41 positioned on the transport slide 4 is formed elastically in the lateral direction relative to the transport direction of the guide channel 31 and extends, when the transport slide 4 is in the end position of FIG. 2 and in the working position of FIG. 3, through the opening 34 extending parallel to the guide channel 31 and into the clear opening of the guide channel. The free end of the first lever arm 45 is supported on the outside surface A of the magazine 3 note FIGS. 2 and 3. When the transport slide 4 is moved in the transport direction, that is, toward the guide 1, the free end of the transport latch 41 interacts with the carrying strip 10. It is also possible for the transport latch to interact with one of the fastening elements 9.

On the opposite side of the magazine 3 from the two-arm lever 44, note FIGS. 2, 3 and 4, a carriage 7 is formed by appropriately bending a piece of sheet metal with its opposite free ends extending essentially perpendicularly to the transport direction and in opposite directions and the carriage extends at least partially along the magazine 3. The carriage 7 has a first free end 72 closer to the guide 1, projecting into a lateral recess in the magazine 3 where it is contacted by a spring element 8 located in a recess 36 and extending in the transport direction. The other or second free end 73 of the carriage 7 projects outwardly from the magazine 3 and has a pulling face 71 facing the guide 1 and interacting with a pulling shoulder 48 on the main body 43 of the transport slide 4 facing away from the guide 1, when the transport slide 4 is shifted into the release position, note FIG. 4.

A retaining element 6, connected to the carriage 7, extends into the clear opening of the guide channel 31 through an opening 33 in the magazine 3 located in the region of the carriage 7. The retaining element 6 has an elastic character laterally to the extent of the guide channel in the transport direction. The free end of the retaining element 6 is located in an end region of the magazine 3 spaced from the guide 1 and prevents the fastening elements 9 from being displaced opposite to the transport direction note FIGS. 2 and 3. Accordingly, the retaining element 6 interacts with one of the fastening elements 9 or with the carrying strip 3.

After all the fastening elements located in the magazine 3 are driven in, the transport slide 4 is in the end position displayed in FIG. 2. Subsequently, the magazine is filled with another carrying strip 3 containing a number of fastening elements 9 through the opening in the guide channel 31 at the free end of the magazine 3. As the carrying strip 10 is pushed in, the fastening elements press the retaining element 6, projecting into the clear opening of the guide channel 31, briefly laterally out of the guide channel. Shortly before a leading fastening element 9 reaches its position in the central bore 14 of the guide 1, the transport latch 41 extending into the clear opening of the guide channel 31 is also pressed out of the guide channel. Immediately after this leading fastening element 9 passes over the transport latch 41, its springy character causes it to rebound into its normal position so that it projects again into the clear opening of the guide channel 31. The retaining element has also assumed its normal position again and projects behind the trailing fastening element 9 in the carrying strip into the clear opening of the guide channel 31.

So that the carrying strip 10 along with the fastening elements 9 can be pushed easily into the end position shown in FIG. 2, the free end region of the magazine 3 is arranged in such a manner that the guide channel 31 is open at its end opposite the guide in the driving direction and the guide channel 31 is closed all around and has a length in the transport direction corresponding at least to the length of the carrying strip 10. In this arrangement, it is possible to insert the carrying strip 10, into the guide channel 31 whereby the strip 10 will have to be pushed through the guide channel 31 which is closed all around, in the direction of the guide only by an amount which corresponds essentially into the length of the carrying strip 10.

To transport the fastening elements 9 automatically into the central bore 14 of the guide 1, initially it is necessary to shift the transport slide manually into the working position of FIG. 3. Then the transport slide 4 is moved opposite to the transport direction, the scroll spring firmly connected to the transport slide 4 is placed under tension and the transport latch 41 on the transport slide 4 is disengaged radially whenever it contacts one of the fastening elements or the carrying strip. The retaining element 6 acting on the trailing fastening element 10 prevents the carrying strip from displacement opposite to the transport direction.

To remove a carrying strip 10 from the magazine 3, it must be assured that the transport latch 41 and the retaining element 6 do not project into the clear opening of the guide channel 31. For this purpose, the transport slide 4 in the free end region of the magazine 3 can be moved into the release position of FIGS. 1 and 4 where it is held against movement in the transport direction. The fixed position of the transport slide is effected with the aid of the two-arm lever 44 on the transport slide 4 where its stop shoulder 42, on the first lever arm 45 and facing toward the guide 1, engages behind a stop shoulder 32 formed on the end of the magazine 3 and facing away from the guide 1, with the first lever arm 45 swiveled closer to the outside surface A of the magazine 3. At the same time, the transport latch 41 located on the second lever arm 46, is pivoted out of the clear opening of the guide channel 31.

When the transport slide 4 is moved into the release position, the pulling shoulder 48 located on the transport slide 4 and facing away from the guide 1, interacts with the pulling face 71, located at the second free end 73 of the carriage 7, and shifts the carriage opposite to the transport direction. At the same time, the spring 8 located in the recess 36 is placed under tension. The retaining element 6, connected to the carriage 7, is pulled over an edge, formed by the opening 33 in the magazine 3, out of the clear opening in the guide channel 31 see FIG. 4.

While specific embodiments of the invention have been shown and described in detail to illustrate the inventive principles, it will be understood that the invention may be embodied otherwise without departing from such principles.

What is claimed is:

1. Apparatus for driving fastening elements (9) in a driving direction into a receiving material, comprises a guide (1) having an axis extending parallel to the driving direction, a magazine mounted on and extending outwardly from said guide (1) perpendicularly to the axis thereof, said magazine (3) forms an enclosed guide channel (31) perpendicular to said guide (1) axis and arranged to receive a carrying strip (10) holding said fastening elements (9) in spaced relation to be transported into said guide (1), said magazine having a free end spaced radially outwardly from said guide (1), said magazine (3) having an outside surface A extending from said guide (1) to the free end of said magazine, said outside surface (A) having a first elongated opening (34) extending in the direction of said guide channel, a transport slide (4) mounted on the outside surface A of said magazine for movement therealong between a release position adjacent to the free end of said magazine, a working position and an end position adjacent to said guide (1), said guide channel (31) being open at the free end of said magazine (3), said transport slide (4) being movable along said outside surface A of said magazine towards the free end thereof against the force of a spring (5), said transport slide (4) having a transport latch (41) elastically displaceable into said guide channel (31) through said first elongated opening and a resilient element elastically displaceable into said guide channel through a second opening (33) located on an opposite side of said magazine from said first opening (34), said retaining element (6) mounted on said magazine, said transport latch (41) and said retaining element (6) arranged to extend into a clear opening in said guide channel (31) for contact with at least one of said carrying strip and said fastening elements, said transport slide (4) being displaceable along said magazine into the release position and said transport latch (41) and said retaining element (6) being displaced out of the clear opening in said guide channel (31) and said transport slide (4) being fixed at the free end of said magazine by a stop surface formed on said transport slide and engaged with a stop shoulder formed in said magazine adjacent the free end thereof.

2. Apparatus, as set forth in claim 1, wherein in the release position of said transport slide (4) said slide is located in the free end region of said magazine (3) and said stop shoulder (32) interacting with said transport slide (4) is formed by the free end of said magazine (3).

3. Apparatus, as set forth in claim 1 or 2, wherein said transport slide (4) has a main body (43) and a two-arm lever (44) pivotally mounted on said main body (43), said stop surface (42) being disposed on a first lever arm (45) of said two-arm lever and facing away from said guide (1), and said transport latch (41) being arranged at a second lever arm (46) of said two-arm lever (44) and said second lever arm facing said guide (1).

4. Apparatus, as set forth in claim 3, wherein as said transport slide (4) is shifted between the working position and the end position, the two-arm lever (44) is supported by said second lever arm (46) at the outside surface (A) of said magazine (3).

5. Apparatus, as set forth in claim 4, wherein said two-arm lever (44) is rotatable about an axis of rotation (47) extending parallel to the driving direction.

6. Apparatus, as set forth in claim 3, wherein said two-arm lever (44) is rotatable about an axis of rotation (47) extending parallel to the driving direction.

7. Apparatus, as set forth in one of claims 1 or 2, wherein said retaining element (6) is connected to a carriage (7) mounted on a second outside surface of said magazine opposite said outside surface A and is displaceable partially towards the free end of said magazine (3) by said transport slide (4) against the force of a spring element (8).

8. Apparatus, as set forth in claim 7, wherein said carriage (7) has a pulling face (71) facing toward said guide (1) and interacting positively with a pulling shoulder (48) on said transport slide (4) and said pulling shoulder (48) facing away from said guide (1).

* * * * *